US008485947B2

(12) United States Patent
Nizam

(10) Patent No.: US 8,485,947 B2
(45) **Date of Patent: *Jul. 16, 2013**

(54) TOTAL BODY STRENGTHENING TONING WORKSTATION AND METHOD OF USING SAME

(76) Inventor: Nash Nizam, Thornhill (CA)

( * ) Notice: Subject to any disclaimer, the term of this patent is extended or adjusted under 35 U.S.C. 154(b) by 232 days.

This patent is subject to a terminal disclaimer.

(21) Appl. No.: 13/067,634

(22) Filed: Jun. 16, 2011

(65) Prior Publication Data

US 2011/0251034 A1 Oct. 13, 2011

Related U.S. Application Data

(63) Continuation-in-part of application No. 12/149,631, filed on May 6, 2008, now Pat. No. 7,985,167, which is a continuation-in-part of application No. 11/233,064, filed on Sep. 23, 2005, now abandoned.

(60) Provisional application No. 60/630,208, filed on Nov. 24, 2004.

(51) Int. Cl.
*A63B 21/00* (2006.01)
*A63B 21/062* (2006.01)
*A63B 21/06* (2006.01)

(52) U.S. Cl.
USPC ..... 482/100; 482/92; 482/93

(58) Field of Classification Search
USPC ..... 482/94, 99, 93, 62, 904, 138, 139, 482/98, 100, 101; D21/662, 673, 676, 680
See application file for complete search history.

(56) References Cited

U.S. PATENT DOCUMENTS

| | | | |
|---|---|---|---|
| 48,051 | A | 6/1865 | Butler |
| 4,354,675 | A | 10/1982 | Barclay et al. |
| 4,358,108 | A | 11/1982 | Voris |
| 4,422,636 | A | 12/1983 | De Angeli |
| 4,598,908 | A | 7/1986 | Morgan |
| 4,627,615 | A | 12/1986 | Nurkoswki |
| 4,648,594 | A | 3/1987 | Schleffendorf |
| 4,653,751 | A | 3/1987 | Green |
| 4,721,303 | A | 1/1988 | Fitzpatrick |
| 4,856,773 | A | 8/1989 | Deola |
| 4,898,381 | A | 2/1990 | Gordon |
| 4,913,423 | A | 4/1990 | Farran et al. |
| 4,915,379 | A | 4/1990 | Sapp |
| 4,953,855 | A | 9/1990 | Shields |

(Continued)

*Primary Examiner* — Oren Ginsberg
*Assistant Examiner* — Sundhara Ganesan

(57) ABSTRACT

A stand-alone exercise apparatus includes a seat to support a user in a position thereon, and upper and lower body exercising assemblies which are configured for activation either sequentially or simultaneously to permit the concurrent exercising movement of his or her upper body area and lower body leg muscles, respectively, without necessitating that the user stop exercising when switching from upper body exercises to lower body exercises. The lower body exercising assembly includes a lower frame assembly which is operable to provide resistance exercise to the user's leg muscles, and which includes a selectively reciprocally movable pedal, platform or bar which is coupled to a suitable resistance mechanism, and which is engagable by the user's feet and/or legs as they are moved together in unified movement to effect leg extensions or curls. The upper body exercising assembly includes one or more reciprocally movable frame members, hand pulleys or swing arms coupled to a resistance mechanism, and which are engagable by the user's hands and/or arms. The resistance mechanisms used to provide the selected resistance to the upper and lower exercising assemblies are operable independently from each other, and enable the user to select the degree of resistance to each of the upper and lower body exercising assemblies separately.

20 Claims, 9 Drawing Sheets

U.S. PATENT DOCUMENTS

| | | | |
|---|---|---|---|
| 5,011,140 | A | 4/1991 | Adessi |
| 5,209,714 | A | 5/1993 | Sainte et al. |
| 5,674,167 | A | 10/1997 | Piaget et al. |
| 5,776,040 | A | 7/1998 | Webb et al. |
| 5,795,272 | A | 8/1998 | Brenke |
| 6,095,954 | A | 8/2000 | Svanberg |
| RE37,648 | E | 4/2002 | Fulks |
| 6,416,447 | B1 | 7/2002 | Harmon |
| 6,443,877 | B1 | 9/2002 | Hoecht et al. |
| RE38,057 | E | 4/2003 | Pandozy |
| 6,659,919 | B2 | 12/2003 | Deola |
| 6,705,976 | B1 | 3/2004 | Piane, Jr. |
| 6,860,840 | B2 | 3/2005 | Carter |
| 7,004,890 | B2 | 2/2006 | Webb et al. |
| 7,044,897 | B2 | 5/2006 | Myers et al. |
| 2002/0103058 | A1 | 8/2002 | Webber |
| 2002/0147086 | A1 | 10/2002 | Walsh |
| 2003/0022767 | A1 | 1/2003 | Webber |
| 2003/0096681 | A1 | 5/2003 | Myers et al. |
| 2003/0158018 | A1 | 8/2003 | Giannelli et al. |
| 2004/0009857 | A1 | 1/2004 | Webb et al. |
| 2004/0023762 | A1 | 2/2004 | Lull et al. |
| 2005/0014609 | A1 | 1/2005 | Neff |
| 2006/0258517 | A1 | 11/2006 | Ashley |

TOTAL BODY STRENGTHENING TONING WORKSTATION AND METHOD OF USING SAME

RELATED APPLICATIONS

This application is a continuation-in-part of prior U.S. patent application Ser. No. 12/149,631, entitled "Total Body Strengthening and Toning Workstation and Method of Using Same" which was filed May 6, 2008 now U.S. Pat. No. 7,985,167 as a continuation-in-part of U.S. patent application Ser. No. 11/233,064, filed 23 Sep. 2005 now abandon, and entitled "Total Body Strengthening and Toning Workstation and Method of Using Same", and which claims the benefit of priority to U.S. Provisional Application Ser. No. 60/630,208, filed Nov. 24, 2004, pursuant to 35 U.S.C. §119(e).

SCOPE OF THE INVENTION

The present invention relates to an exercise apparatus and method of its use for providing resistance training exercise movements, and more particularly an exercise apparatus which provides support and biomechanical positioning during various simultaneously or sequentially exercises using the upper body, lower body and core muscles. The exercise device allows for a multitude of upper body exercises concurrent with leg press or double leg lunge movements during safe and aligned total body movements, that allow for high intensity exercises to optimally burn calories and develop lean muscle mass.

BACKGROUND OF THE INVENTION

Currently the two major methods of resistance training to achieve body strengthening and toning are isolation and functional training. Isolation training involves exercises that target muscles of a specific and individual region of the body such as upper body, lower body, or core. The objective with this type of training is to focus only on specific muscles to develop their strength and/or hypertrophy (bulk). While specific muscle groups are worked in isolation, the unused muscle groups are immobile and secured. In contrast, functional training involves exercises that simulate real life situations by incorporating user defined movements that utilize muscles of several regions of the body simultaneously. These exercises are generally performed in a free standing position and without back support to encourage the use of core muscles to provide stabilization while the extremities are being exercised in a coordinated manner. In these types of free standing exercises, the amount of workload that can be sustained during exercise is less than with the isolation method of training due to the increased chance for injuries. For example, when an isolation exercise such as bench press is performed with the user lying on a bench, the chest can take on a greater workload than compared to a functional exercise that also targets the chest such as push-ups. With functional training, as the workload during exercise is reduced, the amount of calories burned and overall muscles development is also reduced.

Although isolation and functional methods are ideally suited for specific fitness objectives, they are inefficient where the primary fitness objective is to use resistance training to burn the maximum amount of calories in the least amount of time, while developing lean muscle mass.

Historically, when resistance training machines were first introduced in the 1950's, the majority of participants were bodybuilders who primarily focused on isolation training to build bulk and achieve muscle definition. Since then resistance training machines have generally continued to focus on the isolation method type of training. With conventional exercise equipment, it has been necessary for fitness clubs to purchase a number of separate exercise machines, each tailored to permit a user to exercise a specific upper, lower or core muscle group. In addition, conventional isolation exercise equipment does not lend itself to the benefits of fuller body exercises, which encourage muscle coordination and the development of core muscles, such as abdominal or back muscles. In addition, performing repetitions using only one region of the body for an extended period of time can be monotonous, and typically does not allow for opportunities to "mix up" exercises as with upper body and lower body in simultaneous or sequential patterns of movement. Increased variety during exercise advantageously enhances the enjoyment of use of the equipment, encouraging the user to workout more intently to achieve the most benefit from each visit to the workstation. In addition to the increased cost and space requirements associated with purchasing a number of different exercise machines, conventional exercise apparatus suffer the disadvantage in that more time is required for users to complete a full exercise regime, particularly during peak periods at gyms.

Certain exercise equipment manufacturers have proposed "multi-function" or universal exercise machines which use a series of pulleys to connect both movable upper and lower body exercising frames to a single resistance mechanism. Such machines are most frequently marketed for in-home use, and continue to suffer the disadvantage that they are adapted to provide resistance exercise to only a single muscle group at any one time. Typically, conventional "multi-function" exercise machines necessitate that the user physically reposition one or more tensioning bands, release pins or pulleys, to selectively connect and disconnect upper and lower equipment frames when switching between upper and lower body exercises. Like existing commercial isolation machines, these multi-function exercise machines continue to focus on the exercise of single muscle groups at any one time as part of a weight training regime.

Both functional and isolation training exercises are accomplished in a multitude of ways such as by using body weight, free weights, exercise machines and so on. When exercise machines are involved, they are generally designed such that a single primary set of muscles (mobilizers) are used to actuate the resistance during each repetition. These 'primary mover' muscles generally involve either the upper body or lower body muscles. With movements that involve more than one region of the body as with functional exercises, the resistance provided to the 'primary movers' also acts as the workload for other regions of the body. There is therefore, a sharing of the weight by the other regions of the body during exercise. It is not possible, in the case of functional training, to provide customized workload that targets the upper and lower body independently during exercise. An advantage of this feature would be, for example, in the case of many women who wish to utilize a greater workload on the legs than with arms so that they can target their problem areas and not build a heavy upper body, yet use a sufficient overall workload that would allow them to burn a maximum amount of calories during the workout.

Today the majority of participants are not as interested in building muscle bulk or weight gain but on burning calories, improving their cardiovascular system and developing lean muscle mass in the most efficient manner. The applicant has appreciated that the simultaneous use of multiple regions of the body during each repetition using safe biomechanical movements would allow the body to lift greater overall weight in the same period of time, consequently burning more calories and developing lean muscle mass as compared with either functional or isolation training. Furthermore, the benefits from Peripheral Heart Action (PHA), a condition that requires the heart to work harder, as it pumps blood to extremities at opposite ends of the body during upper and lower body simultaneous exercises, may also be utilized. As the heart works harder during PHA, the cardiovascular system is exercised and a greater number of calories are burned. Furthermore, total body exercises allow for a better fatigue management system and encourage muscle endurance exercises that develop lean muscle mass.

SUMMARY OF THE INVENTION

An object of the present invention is to improve on the isolation and functional methods of resistance training by providing a new machine and method of exercise which is effective to optimally burn calories and develop lean muscle mass in the least amount of time.

Another object of the present invention is to provide a resistance training machine that allows for proper support and biomechanical positioning of the body during exercise, such that high intensity simultaneous or sequential resistance training exercises of the user's upper and lower body muscles can be performed with minimal chance of injury.

Another objective of the present invention is to provide a machine that allows for natural and rhythmic total body movements, such that users can exercise both upper body and lower body muscle groups with workloads higher than with functional or isolation exercises, with minimal change in perceived exertion or perceived effort.

Another object of the present invention is to provide an exercise apparatus for effecting simultaneous arm and leg muscle group exercises, and which is operable to permit independent resistance to the upper and lower body during total body movements to produce one or more benefits such as customized workouts, core use, coordination of muscles, and Peripheral Heart Action.

A further object of the invention is to provide a unitary or standalone commercial grade exercise machine that allows for simultaneous upper and lower body exercises during use, thereby encouraging the user to exercise more intently and effectively.

Another object of the invention is to provide an exercise machine that more closely utilizes the total body during exercises thereby allowing for a better fatigue management system and encouraging muscle endurance exercises that develop lean muscle mass.

A further object of the invention is to provide an exercise apparatus which is adapted for the simultaneous or sequential rhythmic exercise of a user's arms and leg muscle groups, and which includes as part of a lower body exercising assembly, a movable lower frame member which is engagable by the user's feet in a unified movement to effect leg exercises, such as full or partial leg presses or double leg lunges.

In a simplified construction, the present invention provides an exercise apparatus which includes a bench or seat to support a user in a position reclined thereon, an upper body exercising assembly which is actuable to perform arm exercises, and a lower body exercise assembly which is actuable by the user to perform leg exercises. The seat includes a seat back support which is configured to support the user's spine in contact thereagainst. Preferably, the seat back is inclined vertical at an angle selected at between about 10° and 60°, preferably at between about 40° and 60°, and most preferably at an angle of between 30° to 50°, to support the user's torso and spine in a similarly partially inclined position in an exercising position thereon.

The upper and lower body exercising assemblies are configured for activation simultaneously and/or sequentially to permit the user to effect exercising movement of his or her upper body muscle and lower body leg muscles, respectively without necessitating that the user stop exercising or manually reposition pins, pulleys, belts or the like when switching from upper body exercises to lower body exercises. Surprising, simultaneous exercise further advantageously allows the user to lift greater overall weight by utilizing concurrently not only arm and leg muscle groups, but also the user's abdominal or core muscles. For the same number of repetitions, a user may thus lift more weight, with little change in perceived exertion allowing more effective calorie burning and the more rapid development of lean muscle mass.

In one possible construction, the lower body exercising assembly includes a lower frame assembly which is operable to provide resistance exercise to the user's leg muscles. The lower frame assembly may, for example, include a selectively reciprocally movable pedal, plate, platform, bar or the like (hereinafter generally referred to as a foot support). The foot support is coupled to a suitable resistance mechanism, and which is engagable by the user's feet so as to be reciprocally moved. Preferably, the foot support is configured for engagement by both of the user's feet simultaneously as the user's legs are moved together in unified movement to effect either leg presses or double leg lunges.

Most preferably, the foot support is mounted for reciprocal movement relative to the seat back between a first rest position spaced towards the seat, and a second position moved away from the seat back relative to the first rest position. Preferably, the seat and lower frame assembly are provided with a relative spacing and height selection which is chosen, such that in the first rest position, the foot support engaged by the user's feet, with the user's legs bent at the knee and hips, the user's shins in general alignment ±45°, preferably ±25°, and most preferably ±15° with the angle of inclination of the back support and the user's torso. More preferably, as the foot support is moved to the second position in leg exercises, the foot support moves downwardly and optionally outwardly relative to the seat. Most preferably, the foot support moves along an arc or path of movement selected such that the user's shins are substantially maintained generally aligned with the relative angle (±) of inclination of the back support, as the user's legs are extended and retracted with the reciprocal movement of the foot support during leg exercises. In this configuration, the resistive forces provided by the lower body exercising assembly on the user's body are maintained in general alignment with the angle of inclination of the seat back and the user's spine. This advantageously acts to direct force vectors along the user's torso and through the core muscles, while minimizing pressure contact between the base of the user's spine and the seat back.

The upper body exercising assembly is preferably selectively actuable by the user extending and/or retracting his or her arms. In one possible construction, the upper body exercising assembly includes one or more reciprocally movable frame members or swing arms which are coupled to a resistance mechanism, and which are engagable by the user's hands and/or arms. Alternately, the apparatus could incorporate selectively actuable hand pulleys which include hand grips secured to the end of pulley wires. Most preferably, the reciprocally movable frame member, swing arm, or pulleys (hereinafter generally reciprocally movable members) are actuable in movement so as to provide resistance forces against the movement of the user's arms in directions tangential or opposite to the downward sloping direction of inclination of the seat back. The upper body exercise assembly may be constructed to effect a variety of upper body or arm exercises including chest presses, rowing, upright rowing, bicep curls, tricep extensions, shoulder presses, pectoral flys and lateral raises. In particular, in a most preferred construction, the reciprocally moveable members of the upper body exercising apparatus are moveable against a resistance load by the engagement with the user's arms and/or hands from an initial rest position to a displaced position in a direction selected at between about 70° and 315°, and preferably greater than 80° to about 280° and most preferably about 90° to about 270° relative to the downward inclination direction of the seat back. The applicant has appreciated that in so limiting the direction of movement of the arm members against the resistance load, the user's arms and legs may be simultaneously moved against resistance forces to provide a faster, more efficient total body workout. Further, as the opposing resistance force vectors provided by the respective upper and lower body resistance mechanisms are thus either substantially tangential or opposed to each other, the non-alignment of the resistance force vectors provided by the upper and lower body exercising assemblies advantageously prevents the compounding lift forces on the user's body during simultaneous upper and lower body exercises better enabling the user to maintain an optimum body position against the apparatus seat and/or seat back.

In one simplified construction, the reciprocally movable members of the upper body exercising assembly are operable to move from the initial rest to the displaced position in a direction generally perpendicular ±15° to the surface of the seat back. In this configuration, resistive forces provided by the upper body exercising assembly are maintained substantially non-aligned and preferably substantially normal to the forces provided by the lower body exercise assembly. This in turn allows the user to select comparatively higher leg weights or resistance, and still simultaneously effect upper and lower body exercises, without arm resistance providing a contributing "lift" force in the upward sloping direction of seat back inclination on the user.

The resistance mechanisms used to provide the desired degree of resistance to the upper and lower exercising assemblies are most preferably operable independently from each other, and enable the user to select the degree of resistance to each of the upper and lower body exercising assemblies separately. With this construction, the desired degree of resistance for leg exercises may be pre-selected by the user, independently from the resistance to be used for toning upper body exercise. This furthermore advantageously allows the user to operate the upper and lower body exercising assemblies both simultaneously to effect the concurrent resistance exercise of his or her arm and leg muscle groups or alternately sequentially or independently to provide a more varied and customized workout and greater apparatus versatility.

Suitable resistance mechanisms to be used with the present invention include arrays of one or more resiliently bendable rods, resiliently deformable elastomeric bands, weight stacks, or other such suitable devices, and which would be suitable to permit either the alternating sequential and/or simultaneous exercising of upper and lower body muscle groups, including without restriction, the user's leg, back, abdominal and/or arm muscles. In a simplified construction, the apparatus incorporates a weight stack assembly as a resistance mechanism which includes a number of vertically displaceable metal plates. The weight stack assembly is coupled to both the lower body exercising assembly and the upper body exercising assembly, such that different groupings of weight plates may be pre-selected by the user for upper and lower body exercise. Following the selection of the desired amount of resistance, the upper and lower frame assemblies are concurrently or sequentially actuated, to raise and lower the selected plates as the user performs arm and leg exercises. In one possible embodiment, the weight stack assembly may include at least two independently operable weight stacks which operate by way of lift rods, and which are each independently coupled by a respective cable/pulley assembly to the upper body exercising assembly and the lower body exercising assembly, provide the user-selected desired degree of resistance. This construction advantageously enables the user to quickly and easily lift different combinations of weight plates in the simultaneous exercising of different muscle groups, without requiring the repositioning of weight stack release pins interrupting the flow of repetitions during a set or between sets.

The lift rods extend vertically through an associated array of aligned apertures formed through the weight plates. The upper end of the lift rods is coupled via respective cable/pulley assembly or other suitable linkage to movable frame members of the exercise apparatus used to provide exercise movement to the user's arms and legs. In this manner, the activation of the exercise apparatus frame members selectively raises and lowers the lift rod associated therewith, providing resistive tension. Each weight stack preferably includes one or more release pins used in selecting the weight of resistance to be provided. The pins are insertable into selected grooves, notches or recesses formed in a surface of each weight plate, and have a length chosen so as to extend into and engage a selected retention hole formed in the lift rod aligned therewith. The engagement of the release pins with the associated lift rod hole couples the pin, together with each of the weight plates stacked there above, to its associated lift rod for movement therewith.

The applicant has appreciated that concurrent resistance exercise of both upper arm and lower leg muscle groups advantageously also effects toning exercise of the user's bridging abdominal muscles. Abdominal muscle exercises are furthermore enhanced and optimized when the lower body leg muscles are exercised by effecting double leg lunges or leg presses, with the user's legs moved together in unified movement.

The applicant has appreciated that the invention is operable to provide toning exercises, as contrasted with isolation weight training exercises which are used primarily to increase muscular bulk. In this regard, in one aspect, the individual weight stacks used to provide resistance may be made comparatively lighter than those found on conventional exercise machines adapted to achieve isolated muscle exercise. Most preferably, the weight stack assembly is configured to provide a greater weight resistance to the lower body exercising assembly which is actuable by the user's legs, than compared with the weight resistance provided to the upper body exercising assembly used to provide arm exercise. In a preferred embodiment, the individual weight stack used to provide resistance to a lower frame assembly may be selected to provide a range of resistance forces of less than about 300 lbs, preferably less than about 250 lbs, and more preferably less than about 200 lbs. Similarly, the weight stack used to provide resistance to the upper body exercising assembly for upper body exercise, may be made comparatively smaller and provide a preferred maximum resistance force of less than about 250 lbs, and more preferably about less than a maximum of 150 lbs. The comparatively smaller weight stacks of the present invention furthermore advantageously enable the exercise apparatus to be made lighter as a stand-alone unitary machine and smaller than conventional isolation exercising equipment, thereby providing the apparatus with an overall smaller footprint, and minimizing the square footage operational cost to health club purchasers.

The invention is operable by a user to undertake a full body toning workout by either simultaneously exercising both upper and lower body muscle groups or by alternating upper and lower body exercises. In a most preferred mode of operation, in use, the user initially pre-selects the desired resistance forces to be used with both the upper body exercising assembly and the lower body exercising assembly. Once the desired resistance is chosen, the user sits on the bench or seat and reclines against the seat back in an exercise position with his or her spine supported by the seat back at the seat back angle of inclination. In this position, the upper body exercising assembly is engaged by the user's hands or arms, with the movable foot support of the lower body exercising assembly engaged by his or her feet and/or legs. The foot support of movable lower body frame member is reciprocally moved between the first rest position to the second spaced position against the pre-selected resistance of the first weight stack. Leg exercises are performed by the user performing double leg lunges or leg presses with the user's legs extended and retracted together in unison, and with the resistance forces of the resistance mechanism returning the foot support from the second position back to the rest position while directing force vectors generally parallel to the user's torso.

Concurrently with the movement of the lower body exercising frame, the upper body exercising apparatus is preferably actuated. The reciprocally moveable members of the upper body exercise apparatus are moved by the user's arms and/or hands against the resistance forces of the second weight stack between the initial rest position and the displaced position to exercise the user's arm and/or torso muscles. As the respective lower frame and upper body frames are used simultaneously to exercise the user's arms and legs, the simultaneous exercising of upper and lower body muscle groups enables the user to undertake a more full body toning workout. Furthermore, because the leg muscles are not exercised in isolation, but rather, resistance forces are transmitted in parallel to the user's spine and through the torso. The concurrent activation of the upper and lower body frame members achieves exercise of not only the user's arm and leg muscles in isolation, but also the user's bridging abdominal and back muscles. Furthermore, since the legs are not extended substantially perpendicularly relative to the backrest, compressive forces to the base of the spine which are enhanced due to the upper body work load are minimized, reducing the likelihood of injury.

Accordingly, in one aspect the present invention resides in the use of an exercise apparatus to effect simultaneous upper and lower body strengthening in a user, the apparatus comprising, a seat having a seat back support for supporting said user in an exercising position with said user's spine juxtaposed thereon, the back support being inclined from vertical at a downwardly sloping angle selected at between about 10° and 60°, a lower frame assembly including a foot support actuable in movement by the extension and retraction of said user's legs, the foot support being movable along a first path of movement from a first raised position to a second lowered position, a first resistance mechanism coupled to the lower frame assembly and operable to selectively vary resistance to foot support movement, an arm exercising assembly actuable to exercise arm muscles of said user when in the exercising position, the arm exercising assembly including at least one reciprocally movable member which is selectively movable by said user's hands or arms along a second path of movement from an initial rest position to a displaced position moved therefrom, the second path of movement extending generally in a direction oriented at between about 80° and 280° relative to the downward inclination of said seat back, a second resistance mechanism coupled to said arm exercising assembly and operable to vary resistance to movement of said arm exercising assembly independently from said first resistance mechanism, wherein with said user in said exercising position, simultaneously actuating said lower frame assembly and said arm exercise assembly to effect simultaneous upper and lower body exercise, whereby ,the exercising position comprises positioning the seat with said back support inclined from vertical such that the user can reach the lower frame assembly with said user's feet engaging said foot support while said user's hands engage said arm exercising assembly, in actuation of said lower frame assembly, said user engages said foot support with his or her feet to alternately extend and retract said user's legs together in unison in leg press-type exercises to move said foot support between the first raised and second lowered positions, and whereby in movement of the foot support from the first raised position to the second lowered position, the lower frame assembly maintains an orientation of the user's shins in a position generally parallel ±45° to the angle of inclination of the seat back, and as said user's legs are extended, the user simultaneously urges said reciprocally movable member with said user's arms from said initial rest position towards said displaced position.

More preferably, in the aforementioned use, the arm exercising assembly is selected from either a chest press assembly, upright row assembly, a bicep curl assembly, a tricep extension assembly, a shoulder press assembly, pectoral fly assembly or a lateral raise assembly.

In another aspect, the present invention resides in the use of an exercise apparatus to effect muscle strengthening and toning in a user, the apparatus comprising, a seat having a seat back support for supporting said user's spine in an exercising position thereagainst, the back support being fixedly positioned inclined in a downwardly sloping direction from vertical at an angle selected at between about 10° and 60°, a lower frame assembly actuable by said user to effect leg muscle exercises, the lower frame assembly including a foot support which is reciprocally movable relative to the seat between a first position, wherein said foot support is engagable by said user's feet with said user's legs bent and the user's shins in general alignment ±45° with the angle of inclination back support, and a second position moved downwardly away from the seat, wherein said foot support is engagable by said user's feet with said legs in a generally outstretched position while maintaining the user's shins in general alignment ±35° with the angle of inclination of the back support, a first resistance mechanism coupled to the lower frame assembly and operable to provide a user selected resistance to foot support movement, an arm exercising assembly actuable to exercise arm muscles of said user when in the exercising position, the arm exercising assembly including a reciprocally movable member which is selectively movable by said user's hands and/or arms from an initial rest position and a displaced position moved therefrom in a direction oriented at between about 80° to about 280° relative to the downward sloping direction of the back support, a second resistance mechanism coupled to said arm exercising assembly and operable to provide a user selected resistance to movement of said reciprocally movable member independent from said first resistance mechanism, wherein in use of the apparatus, the exercising position comprising providing the seat with the seat back support inclined from vertical in a position whereby the foot support is engagable by said user's feet while said user's hands or arms engaging said arm exercising assembly, said user simultaneously activates said lower frame assembly and said arm exercise assembly whereby, in actuation of said lower frame assembly, said user engages said foot support with both of his or her feet to alternately extend and retract said user's legs together in unison in leg exercises to move said foot support between the first position and the second position, and with or immediately following each extension and retraction of said user's legs, said user moves said hands and/or arms to reciprocally move said reciprocally movable member against the resistance of the second resistance mechanism from said initial rest position to said displaced position.

In a further aspect, the present invention resides in a use of an exercise apparatus to effect simultaneous arm, leg and core muscle group exercises in a user, the apparatus comprising, a seat having a seat back support for supporting said user's spine in an exercising position, the back support being oriented in a downward inclined first direction relative to vertical at an angle selected at between about 25° and 50°, a lower frame assembly actuable by said user to effect leg muscle exercises, the lower frame assembly including a foot pedal which is engagable by the soles of said user's feet in reciprocal movement relative to the seat between a first rest position to a second position moved downwardly therefrom, a first resistance mechanism coupled to the lower frame assembly to provide a selected resistance to foot support movement towards the second position, an arm exercising assembly actuable to exercise arm muscles of said user when in the exercising position, the arm exercising assembly including a reciprocally movable member which is selectively movable by said user's hands and/or arms between an initial rest position and a displaced position moved therefrom in a second direction oriented at between 80° and 280° relative to the first direction, and a second resistance mechanism coupled to said arm exercising assembly to provide a selected resistance to the movement of reciprocally movable member towards the displaced position independent of said first resistance mechanism, whereby positioning the apparatus to support the user in the exercising position with said user's spine is in juxtaposed contact with said seat back inclined relative to vertical whereby said user's feet concurrently engage said foot pedal while said user's hands and/or arms engaging said arm exercising assembly, actuating said lower frame assembly, whereby said user engages said foot pedal with the soles of both of his or her feet, and symmetrically extends and retracts said legs in unison in leg exercises to move said foot support between the first and second positions, with the first resistance mechanism and foot support providing a resistance leg force to said user's legs in a direction ±35° the direction of inclination of the seat back, and said user substantially simultaneously moves said reciprocally movable member from said initial rest position to said displaced position, with the second resistance mechanism and reciprocally movable member providing a resistance arm force to said user's hands and/or arms in a direction generally opposite to the second direction.

BRIEF DESCRIPTION OF THE DRAWINGS

Reference may now be had to the following detailed description taken together with the accompanying drawings in which.

DETAILED DESCRIPTION OF THE PREFERRED EMBODIMENTS

Figure 1:
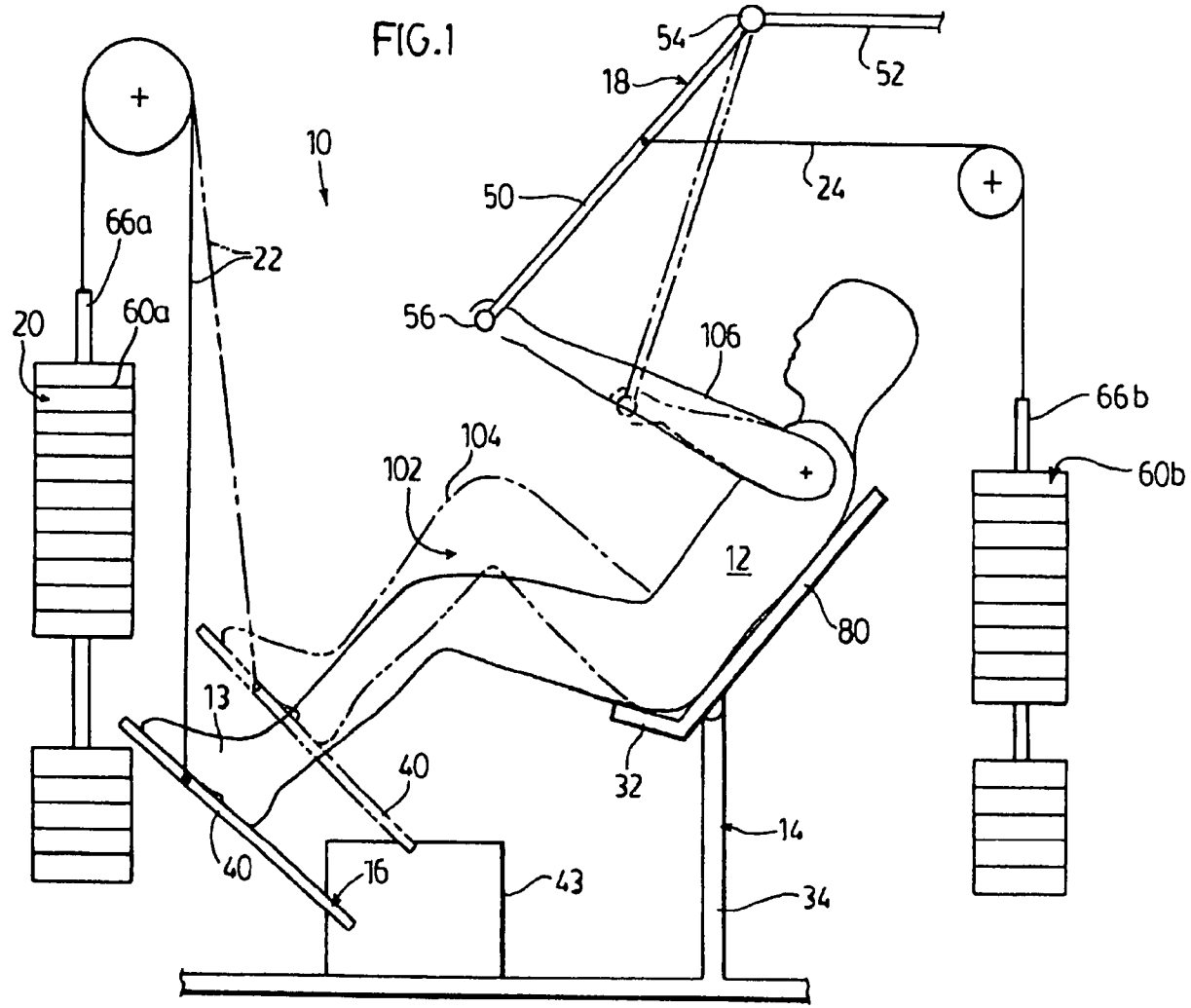
FIG. 1 shows schematically a stand-alone exercise machine in accordance with a first embodiment of the invention.

Reference is first made to FIG. 1 which illustrates schematically an exercise machine 10 which, as will be described, is operable to effect simultaneous toning exercise movement of a user's 12 upper, lower and abdominal muscle groups. The exercise machine 10 is provided with a seating/support frame assembly 14, a lower body exercising assembly 16, an upper body exercising assembly 18, a weight stack assembly 20 and a pair of cable/pulley assemblies 22,24.

The seating/support frame assembly 14 is shown best in FIG. 1 as including a base 30 and a seat 32. The base 30 is formed as a square tubular steel frame and has mounted thereto each of the lower body exercise assembly 16, the upper body exercising assembly 18, the weight stack assembly 20 and the cable/pulley assemblies 22,24. The base 30 has a footprint selected to provide stability to the machine 10 as a unitary stand-alone unit in a health club or the like. The seat 32 is provided to support the user 12 in a seat in a partially reclined exercising position thereon, in a position which allows the user 12 to sequentially and most preferably simultaneously actuate both the lower body exercising assembly 16 and the upper body exercising assembly 18. The seat 32 includes a back support 80 for use in supporting the user 12 with his spine resting thereagainst in juxtaposed contact. The back support 80 is inclined from the vertical axis $A_v$-$A_v$ (FIG. 2A), at a downwardly sloping angle a of between about 10° and 60°; preferably 30° to 50°, and most preferably about 45° to support the user's torso and spine in a corresponding partially reclined position during use of the machine 10. Although not essential, the seat 32 is most preferably coupled to the base 30 by means of a pair of vertical seat supports 34, so as to be pivotable in a front-to-back direction, about a horizontal pivot axis, so as to permit adjustment in the degree of inclination of the seat back 80.

FIG. 1 shows best the lower body exercising assembly 16 as including a reciprocally movable foot support 40 which is engagable by the soles of the user's feet 13. The foot support 40 is mounted for reciprocal pivoting movement towards and away from the seat 32. More preferably, the foot support 40 is mounted to the base 30 forwardly from the seat 32, by means of a vertically extending connecting support 43 which in turn is welded to the lower base 30 of the machine 10. The foot support 40 is coupled to the connecting support 43 by a suitable rotatable mount (not shown). The foot support 40 is furthermore coupled to the weight stack assembly 20 via the cable/pulley assembly 22. The foot support 40 is configured to be reciprocally moved against the resistance forces applied by the weight stack assembly 20 by the extension and retraction of the user's legs 102 (FIG. 1). In this manner, the foot support is movable between a first rest position spaced upwardly and moved towards the seat 32 shown in FIG. 1 in phantom lines, and a second biased position shown in solid lines where the support 40 is moved downwardly and away from the seat 32 as the user's legs 102 are extended downwardly towards an orientation more aligned with the user's spine in partial leg press or double leg lunge type exercise. In a conventional manner, the resilient bias applied by the weight stack assembly 20, returns the foot support 40 to the rest position against the exercise forces applied by the user's legs 102.

The applicant has appreciated that the leg press or double leg lunge range of motion during simultaneously upper body and lower body workout is preferably modified from that of traditional leg press exercises since there is a need to consider the added strain on the user's core area, and particularly the lower back, during concurrent upper and lower body exercise. Traditional leg presses use a range of motion that allows for both the extension of the leg at the knee in a direction generally lateral to the seat; as well as rotation at the hip joint so that all major muscles of the legs are utilized (i.e. glutes, hamstrings, quads, and hip flexors). This range of motion is possible since the upper body is stabilized, as for example, by the user holding onto fixed handle grips during leg exercise. During simultaneous exercises however, the upper body is not stabilized, but is instead utilized during exercise. As such, there is preferably less lateral extension of the legs at the knee and greater rotation at the hip joint as compared to traditional leg presses. This advantageously relieves the strain on the lower back during exercise and also increasingly utilizes the user's hip flexors, glutes and the core muscles as the feet, most preferably, move from a raised position to a lowered position during the leg extension. Also by this method there is less reliance on the weaker muscles surrounding the knee. To at least partially achieve the optimum leg positioning during each extension most preferably, the foot support 40 is positioned so that when engaged by the user's feet 13 in the first rest position the user's legs are bent at the knee and hips, both with the user's shins 104 oriented in general alignment ±35° and preferably ±20° with both the orientation of the user's spine and the back support 80.

Figure 2A:
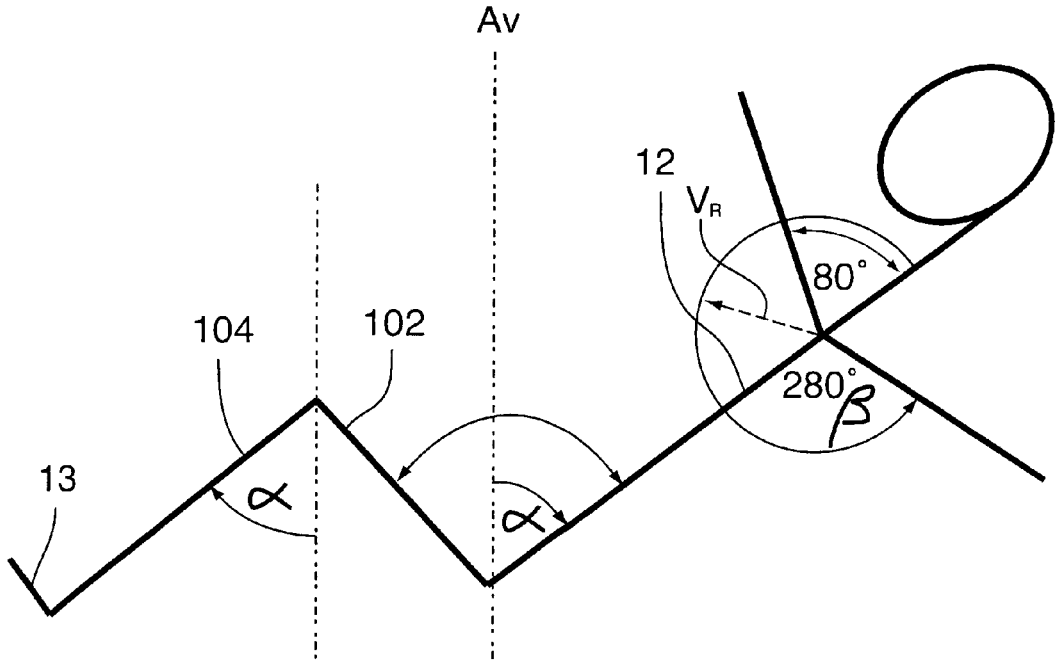
FIGS. 2A and 2B shows schematically the positioning of a user's legs on the apparatus of FIG. 1, with the user's legs moved to a first initial rest position.

As shown in FIG. 2A, with the user's shins 104 generally aligned with the user's torso, initial resistance force provided by the foot support 40 (FIG. 1) is directed generally aligned with the shins 104. Most preferably, the foot support 40 is provided for pivotal movement relative to the seat 32 and frame 30, so that as the support 40 is moved against the resistance of the weight stack assembly 20 along a path of movement between the first and second positions, the user's shins 104 are generally maintained in substantial alignment ±35°, preferably ±25° and more preferably ±15°, with the angle of inclination a (FIG. 2A) of the seat back 80. As shown best in FIG. 3, the applicant has appreciated that with this construction, the resistance force provided by the weight stack assembly 20 and the lower body exercising assembly 16 on the user's legs 102 are oriented along a force vector direction 100 (FIG. 3) which is generally parallel to the user's spine/seat back 80. This advantageously acts to minimize pressure contact between the base of the user's spine or lumbar, and the seat back 80. As a result, leg exercise forces are transmitted through the user's abdominal or core muscles achieving more enhanced mid-body exercise and reducing the chance of injury.

Figure 3:
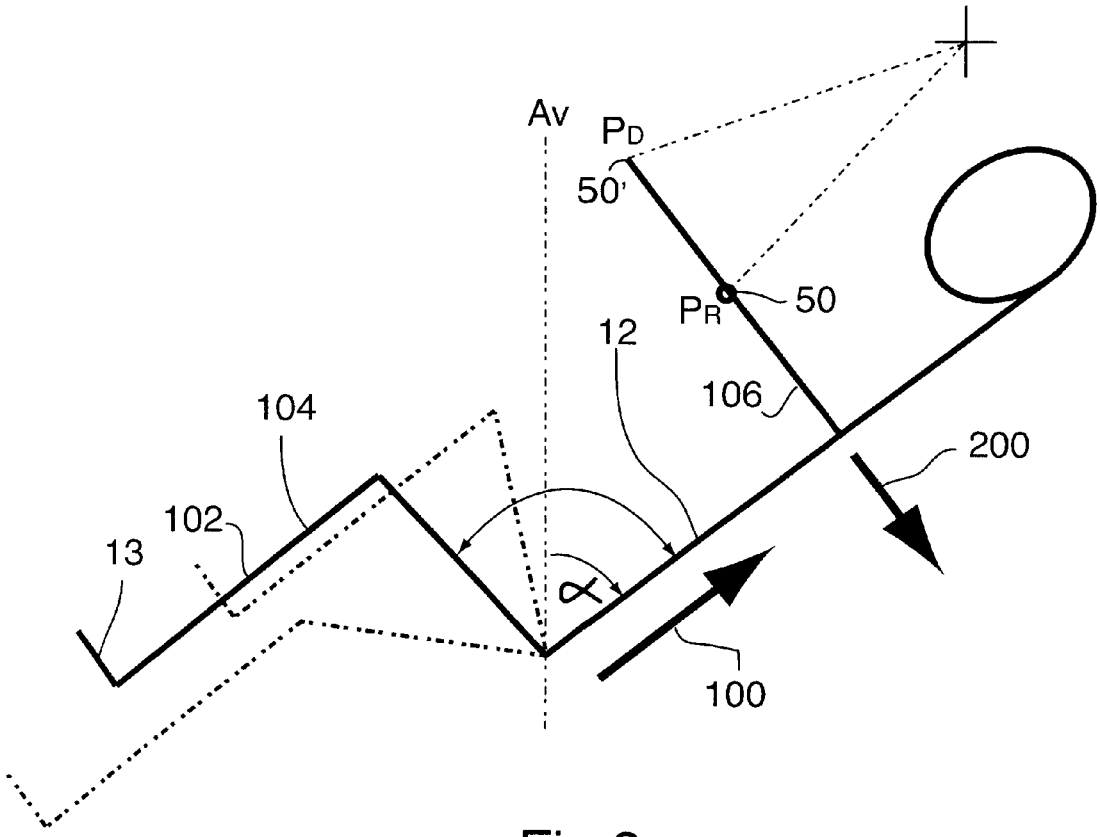
FIG. 3 shows schematically the positioning of the user's legs and arms on the exercise machine of FIG. 1 in operation.

FIGS. 1 and 3 show best the use of the upper body exercising assembly 18 to provide toning body exercise to the user's arms 106 and upper body muscle groups. The upper body exercising assembly 18 includes a vertically displaceable frame member 50 which is secured to a member support 52. The support 52 extends from a position rearward of the seat 32, to position the frame member 50 in front of and above the user 12 when seated thereon. The displaceable frame member 50 is actuable to allow the user 12 to effect chest presses, and is provided with a pair of handle grips 56 which are spaced forwardly of and may be grasped by the user 12 when seated in the exercising position inclined on the seat 32. The frame member 50 is pivotally connected to the support 52 by way of a suitable pivot mount 54, so as to be movable from an initial rest position shown in phantom lines in FIG. 1 to a biased displaced position shown in solid lines. The frame member 50 is most preferably operable to provide resistance forces which are against the movement of the user's arms in directions generally transverse or opposite to the downward sloping direction of inclination of the seat back 80. In this configuration, the upper body exercising assembly 18 may be used without resistance forces provided by frame member 50 tending to raise or pull the user 12 upwardly off of the seat 32 and along the seat back 80.

As shown schematically in FIG. 3 in a chest press exercise the reciprocally movable frame member 50 is movable from an initial rest position $P_R$ to a finish position $P_D$ displaced in a direction oriented transverse to the direction of inclination of the seat back 80. More preferably, the reciprocally movable member 50 is displaceable in a direction which is generally perpendicular ±10° to the seat back 80. The applicant has appreciated that in this configuration, the use of the upper body exercising assembly 18 provides resistance force vector 200 (FIG. 3) generally transverse to both the orientation of the seat back 80 and the force vector 100 provided by the lower body exercising assembly 16.

As will be described, displaceable frame member 50 is coupled to the weight stack assembly 20 via cable/pulley assembly 24, so as to be movable between the rest and displaced positions against resistance forces supplied thereby. Preferably, the resistance forces supplied by the weight stack assembly 20 acts to resiliently bias the frame member 50 to return to the rest position.

Figure 2B:
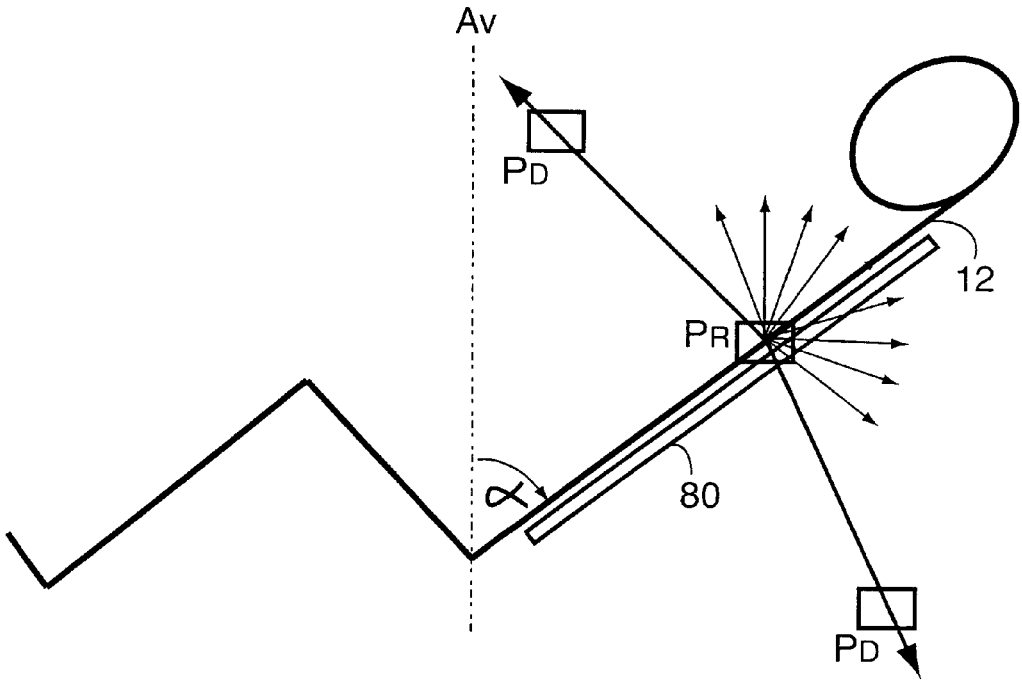

It is to be appreciated however that while an exercising assembly 18 for effecting chest presses in shown, the upper body exercising assembly 18 could also be modified to include a handle or frame members which function as a different upper body exercise assembly, including an upright row assembly, a bicep curl assembly, a tricep extension assembly, a shoulder press assembly, a pectoral fly assembly or a lateral raise assembly. Preferably, the frame member is reciprocally movable between the initial rest and displaced positions with the weight stack assembly 20 providing resistance force vector $V_R$ ,thereagainst oriented at angle β (FIG. 2A) of between 80° and 280°, and preferably 90° to 270° relative to the inclination of the seat back 80. In this regard, as shown best in FIG. 2B the reciprocally movable member 50 is movable against the resistance forces of the weight stack from the rest to displaced positions $P_R$,$P_D$ across a range of directions extending at between about 80° and 280° relative to the direction of downward slope of the seat back 80. Depending on the final configuration of the upper body exercising assembly 18 which is selected, the reciprocally movable member could be movable from the initial rest to the displaced position in directions oriented at upto 280° and preferably about 270° relative to the direction of the seat back.

Figure 4:
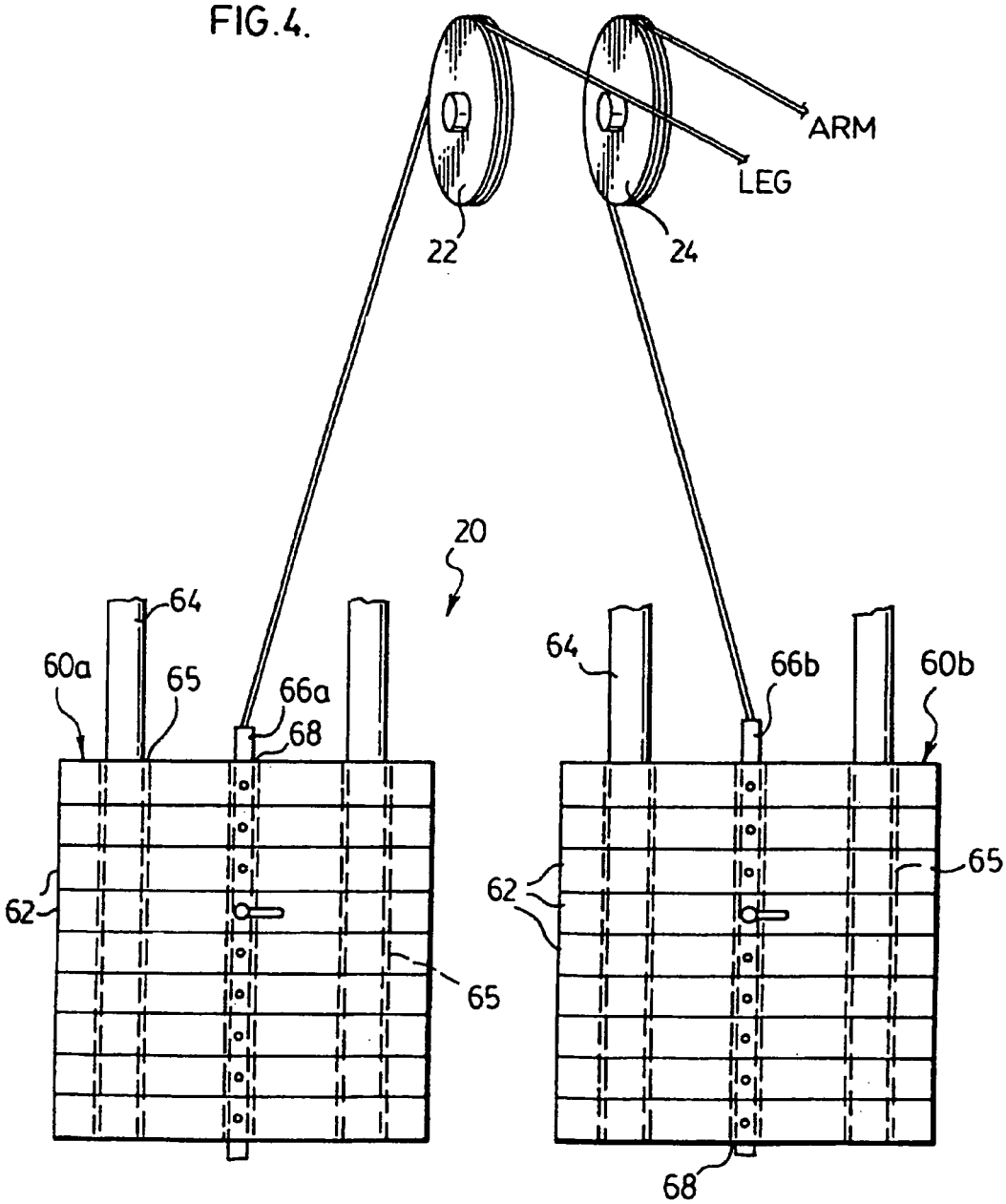
FIG. 4 illustrates a weight stack assembly for use in the apparatus of FIG. 1, with weight stacks for upper and lower body exercise assemblies in an initial rest position.
Figure 5:
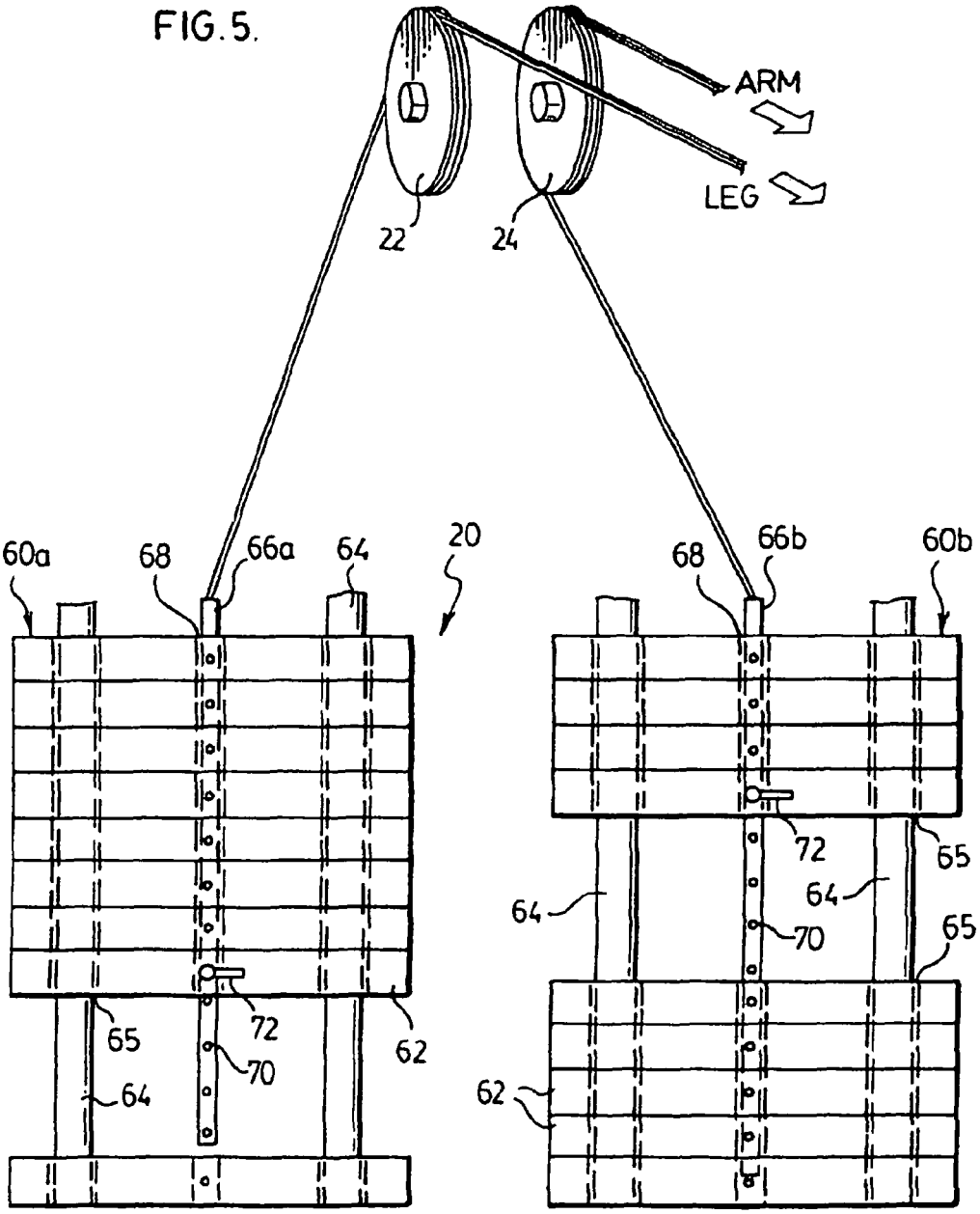
FIG. 5 illustrates the weight stack assembly of FIG. 4 in operation of the apparatus, with weight stacks moved in the concurrent operation of the upper and lower body exercise assemblies in unison.

The weight stack assembly 20 is configured to permit either the alternating sequential, or more preferably simultaneous concurrent operation of the upper and lower body exercising assemblies 16,18. FIGS. 4 and 5 show best the weight stack assembly 20 as including a pair of independently operable weight stacks 60*a*,60*b*. Each of the weight stacks 60 consists of a number of steel weight plates 62 which are slidably mounted for selective vertical movement along a respective pair of tubular frame rails 64. The tubular frame rails 64 of each weight stack 60*a*,60*b* are each coupled to the base 30, so as to provide the exercise machine 10 with its stand-alone construction. Preferably, the weight plates 62 furthermore have side apertures 65 formed therethrough which are sized to receive therein a respective one of the rails 64. It is to be appreciated, however, that other configurations supporting the weight plates 62 as a selectively movable, stacked vertical array may also be used and will be apparent. The weight stacks 60*a*,60*b* are shown best in FIG. 4 as each further including an elongated selectively actuable lift rod 66*a*,66*b*, which extends vertically through a central aperture 68 formed in the centre of each of the weight plates 62 of each stack 60*a*,60*b*. The lift rods 66*a*,66*b* have provided along their length a longitudinally extending array of apertures 70 (FIG. 5). In a conventional manner, the apertures 70 of each lift rod 66*a*,66*b* are respectively engagable by a release pin 72 used to couple a desired number of plates 62 to each lift rod 66, depending upon the desired weight of resistance. The lift rods 66*a* and 66*b* are in turn coupled to a respective cable/pulley assembly 22,24.

As shown best in FIG. 1, the lift rod 66*a* of the weight plate stack 60*a* is connected via the cable/pulley assembly 22 to the foot support 40 to resiliently bias and return the foot support 40 to the first rest position. In addition, the user 12 may simply and easily select the desired degree of resistance forces to the movement of the foot support 40 to be used. In a similar manner, the lift rod 66*b* of the weight plate stack 60*b* is connected to the vertically replaceable frame member 50 by means of cable/pulley 24, to resiliently bias the frame member 50 to the initial position. The apparatus 10 enables the user 12 to select the desired degree of resistance to the movement of the member 50 independently from the amount of resistance provided by the weight stack 60*a* to the movement of the foot support 40, by using the pins 72 to couple the desired number of weight plates 62 to each respective rod 66*a*,66*b*.

In this manner, the weight stack 60*a* is used to provide the selected degree of resistance forces to the movement of the foot support 40 in the exercising movement of the user's legs 102. Similarly, the weight stack 60*b* is operable independently of the weight stack 60*a* to provide a selected degree of resistance forces to the movement of vertically displaceable frame member 50 in use of the exercise machine 10 to exercise the user's arm and upper body muscles.

Because the exercise apparatus 10 is primarily intended for the concurrent workout of upper body, lower body and core muscle groups, as contrasted with isolation exercises adapted to increase muscular bulk, the weight stack assembly 20 may be made lighter and more compact than compared with those found in conventional exercise machines which are adapted to provide isolated muscle exercise. In this regard, the weight stack 60*a* used to provide resistance to the lower body exercising assembly 16 is preferably larger than the weight stack 60*b*. In a simplified construction, the weight stack 60*a* includes a number of weight plates 62 selected to provide a preferred maximum leg resistance force of less than 300 lbs., and more preferably less than about 250 lbs. Similarly, the weight stack 60*b* may be provided with a reduced number of weight plates 62, providing a preferred maximum resistance force of less than about 200 lbs., and preferably less than about 150 lbs. It is to be appreciated, however, that weight stacks of greater or lesser total weight may also be used, depending upon the needs of the individual user.

In an alternate construction, wherein the back support 80 may be adapted for pivotal movement about a horizontal axis, so as to be movable between more upright and more reclined positions. Preferably, in use of the machine 10, the seat 32 may be either locked in place, or alternatively may be freely swiveled. In one possible mode of operation, the bottom of seat 32 may be swiveled downwardly to slope in a forward position when, in the simultaneous operation of the lower body exercise assembly 16 and the upper body exercising assembly 18, the foot support 40 is moved to the second biased position.

A locking mechanism (not shown) may also be provided to selectively secure the seat bottom in either the fully reclined and/or fully upright position, as for example during respective lower and upper body isolated exercise.

An advantage of the present invention resides in that the machine 10 is operable to maximize the user's 'repetitions and/or total weight lifted per visit' as compared to traditional isolation strength training methods wherein users are encouraged to perform 'continuous sets', where repetitions targeting various muscle groups are performed without rest, until muscles are fatigued. As such, the user 12 may obtain an effective workout in a more time efficient manner. With the exercise machine 10, the flow of repetitions involving more than one muscle group, utilizing a resistance level for the upper body that may vary from the lower body, are not interrupted by the need to stop and reposition the pins 72 as exercises are performed. Furthermore, during exercise the user 12 may vary patterns that involve the entire body. In addition, the configuration of the machine 10 allows for the mixing up of repetitions by isolating, consecutive or simultaneous use of the lower body exercising assembly 16 and the upper body exercising assembly 18. This, in turn, makes the machine 10 more enjoyable and interactive, and less monotonous than conventional isolation exercises performed one station at a time.

FIGS. 1 and 3 show schematically a preferred mode of operation of the exercise machine 10 by the user 12, in achieving an exercise workout. To achieve optimal exercise of the user's abdominal muscle groups concurrently with his leg and arm muscles, the user 12 first independently selects the desired degree of weight resistance to be provided by the weight stacks 60*a*,60*b* to each of the upper and lower body exercising assemblies 16,18. The desired degree of weight resistance is selected in a conventional manner, by inserting the pins 72 of each weight stack 60*a*,60*b* into engagement with the desired aperture 70 formed in each of the lift rods 66*a*,66*b*. The user 12 may simply select a lower weight for providing the resistive tension to the cable/pulley arrangement 24 and upper body exercising assembly 16 of the machine 10, by inserting release pin 72 in the desired aperture 70 of the stack 60*b*. A greater number of weight plates 62 may be used to provide exercise resistance to the cable/pulley arrangement 22 in the lower body exercising assembly 18 by inserting release pin 72 into engagement with the selected plate 62 of the stack 60*a*. The user 12 then assumes an exercising position seated on the seat 32, and reclined with the user's back resting against the back support 80. In this position, the user's torso assumes an orientation inclined at the angle $\alpha$ (FIG. 2) corresponding to the angle of inclination of the seat back 80, in an initial forward facing position. The user then places his feet against the foot support 40, bending at the knees and hips, and aligning the shins 104 with the seat back user's spine and seat back 80. In such a position, the soles of the user's feet 13 are positioned in bearing contact against the foot support 40, and the user 12 may reach forwardly extending his arms 106 generally perpendicular to his torso to grasp the handle grips 56 of the frame member 50 with his hands.

In use of the machine 10, the foot support 40 is operable so as to be moved downwardly and outwardly to the second position by the engagement of the user's feet 13 against the foot support 40 as the legs 102 are extended or retracted in unison in partial leg press or leg lunge exercises. The outward downward movement of the foot support 40 as it travels to the second position, advantageously provide a greater range of leg motion and allows the user's shin to maintain its general alignment with the torso. Further, as the legs 102 are extended a greater range of motion occurs at this hip joint, resulting in better use of hip flexors, glutes and core muscles. Furthermore with the added range of motion of the lower body, less constriction of the upper body occurs. This in turn allows the upper body to be exercised more freely with greater effectiveness and comfort.

To effect an exercising workout, the user 12 extends both of his legs 102 simultaneously moving the heels of the feet 13 with the support 40 outwardly and downwardly from the initial rest position together in unison. The movement of the foot support is effected against the selected resistance force provided by the weight stack 60*a*, as the cable/pulley 22 draws the rod 66*a* upwardly to vertically raise the selected number of weight plates 62 of the stack 60*a*. It is to be appreciated that the seat 32 is provided with a seating surface which is configured so as not to substantially interfere with the extension of the user's legs 102 with the moving foot support 40. In this regard, the seating surface of the seat 32 may be provided with either an inclined and/or shortened configuration so as to permit the desired degree of rotation of the user's legs about his hips.

Concurrently with the extension of the user's legs 102, the user 12 uses his arms 106 to push on the frame assembly 50 away from the seat back 80 and the torso, effecting its movement from the initial rest position to the biased position shown in solid lines in FIG. 1. The movement of the frame member 50 towards the seat 32 occurs against the upper body resistance forces applied by the cable/pulley assembly 24 drawing the rod 66*b* upwardly, to raise the user selected number of weight plates 62 of the weight stack 60*b*. Once the foot support 40 and frame member 50 reach their respective second and maximum displaced positions, the foot support 40 and frame member 50 are then returned by the user 12 providing resistance against the return forces of respective weight stacks 60*a*,60*b* to their initial rest positions, and the cycle is then repeated. The applicant has appreciated that the concurrent exercising movement of the user's arms 106 and legs 102, in addition to strengthening the respective upper and lower muscle groups, advantageously also acts to exercise the user's bridging abdominal muscles. As a result, the user may obtain a faster, full body toning workout.

An advantage of the present machine 10 exists in that it enables the simultaneous exercise on the single machine of both upper and lower body muscle groups while directing force vectors from the upper body exercising assembly 16 through the user's torso. As such, the exercising machine 10 advantageously functions more closely to provide free standing-type exercising where the user's core muscles are activated concurrently with arm and leg exercising, and which is not possible with conventional strength training gym equipment. Furthermore, the use of the machine 10 permits the user 12 to engage his or her body muscles more fully and permits either greater number of repetitions of exercise movement or an increase in the overall weight lifted. As such, by exercising both upper and lower body muscle groups, the machine 10 may advantageously provide enhanced fat burning and/or more effective muscle development.

Figure 6:
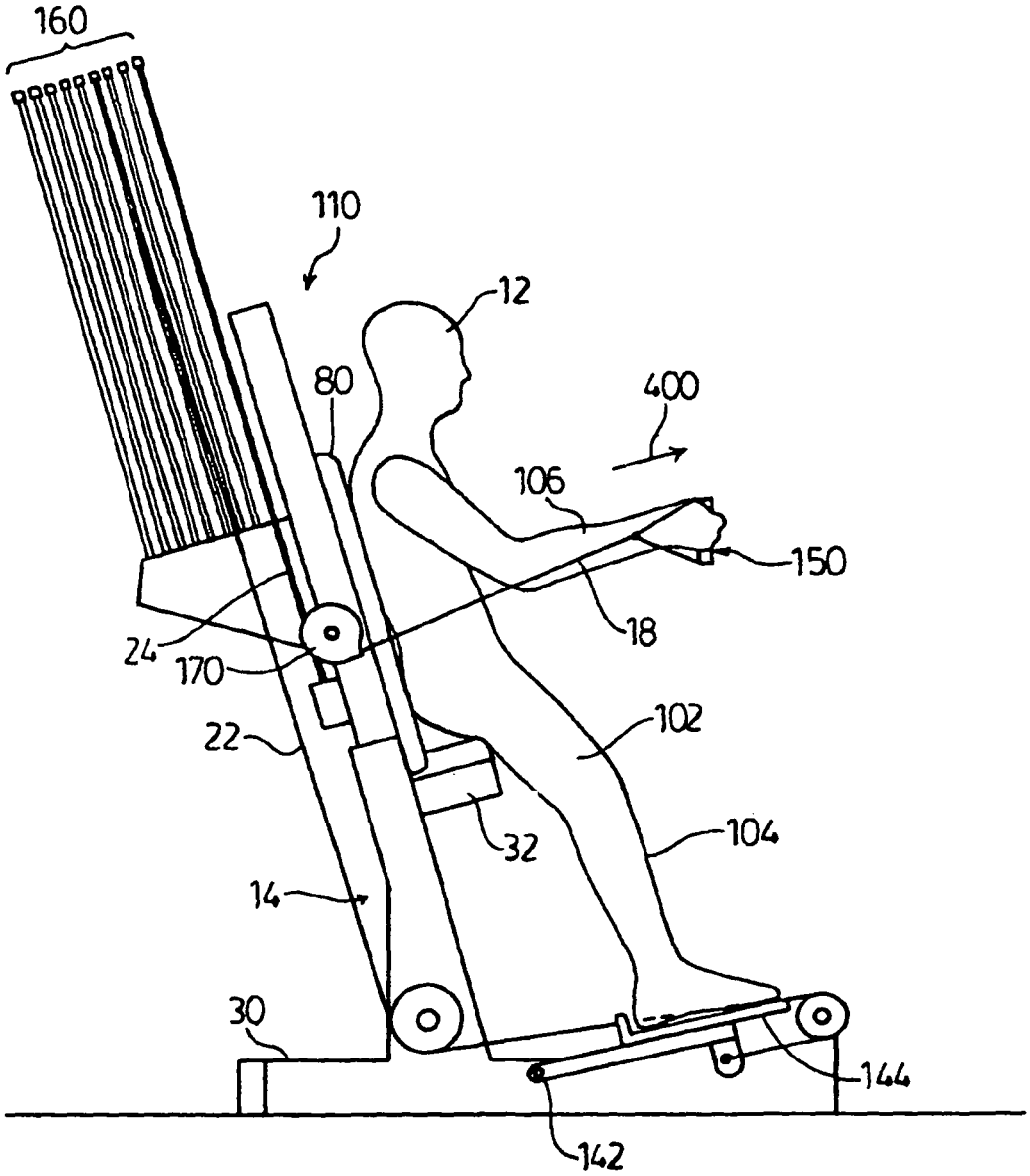
FIG. 6 illustrates a perspective view of an exercise apparatus in accordance with a second embodiment of the invention.

Although the preferred embodiment of the invention discloses a weight stack assembly 20 consisting of a pair of weight plate stacks 60*a*,60*b* as a preferred resistance mechanism, the invention is not so limited. It is to be appreciated that other types of resistance mechanisms are also envisioned, including resiliently deformable elastomeric members, as well as resiliently deformable bendable rods, and will now become apparent. Similarly, although FIG. 1 illustrates an exercise machine 10 having a vertically displaceable frame member 50 as being used to provide upper body exercise, and a selectively rotatable foot support 40 for lower body exercise, the invention is not so limited. In alternate possible constructions the upper body exercising assembly 18 could be modified to include a chest press assembly, a bicep curl assembly, a tricep extension assembly, a shoulder press assembly, a pectoral fly assembly or a lateral raise assembly. FIG. 6 shows one alternate embodiment of an exercise machine 110 adapted for the simultaneous exercise movement of a user's upper and lower muscle groups, wherein like reference numerals are used to identify like components. In FIG. 6 the exercise machine 110 includes an array of bendable rods 160 in place of the weight stack assembly for providing resistance to the upper and lower body exercising assemblies 16,18.

FIG. 6 shows best the machine 110 as including a seat 32 which is provided in a fixed position partially inclined on the seating/support frame 14. The seat 32 is provided in a fixed position with the seat back 80 inclined so as to support the user 12 in a position seated thereon with his or her spine inclined rearwardly at an angle of between about 10° and 40° from vertical. The machine 110 incorporates a lower body exercising assembly 16 which includes a movable foot frame 144 which is coupled for reciprocal pivotal movement to the base 30 in a generally downward curving arc of movement by way of a pivot pin 142. As shown best in FIG. 7, the foot frame 144 includes a generally planar foot plate 144 which is sized and positioned so as to be simultaneously engaged by both of the user's feet in the performance of leg press-type exercises, as the user's legs 102 are fully extended.

In place of the vertically displaceable frame member 50 (FIG. 1), the upper body exercising assembly 18 of the machine 110 includes a pair of cable operated hand pulleys 150. The hand pulleys 150 are connected directly to a selected number of bendable rods 160 via the cable/pulley assembly 24, for use in effecting exercise movement of the user's arms 104. The machine 110 provides the desired degree of resistance to the movement of the upper and lower body exercising assemblies 16,18 by coupling or uncoupling a selected number of rods 160 to each cable/pulley assembly 22,24. The rods 160 may, for example, be configured similar to those found on the Bowflex™ exercise machines and provide resistance via the respective cable/pulley assemblies 22,24 to the movement of the foot frame 140 and hand pulleys 150.

Figure 7:
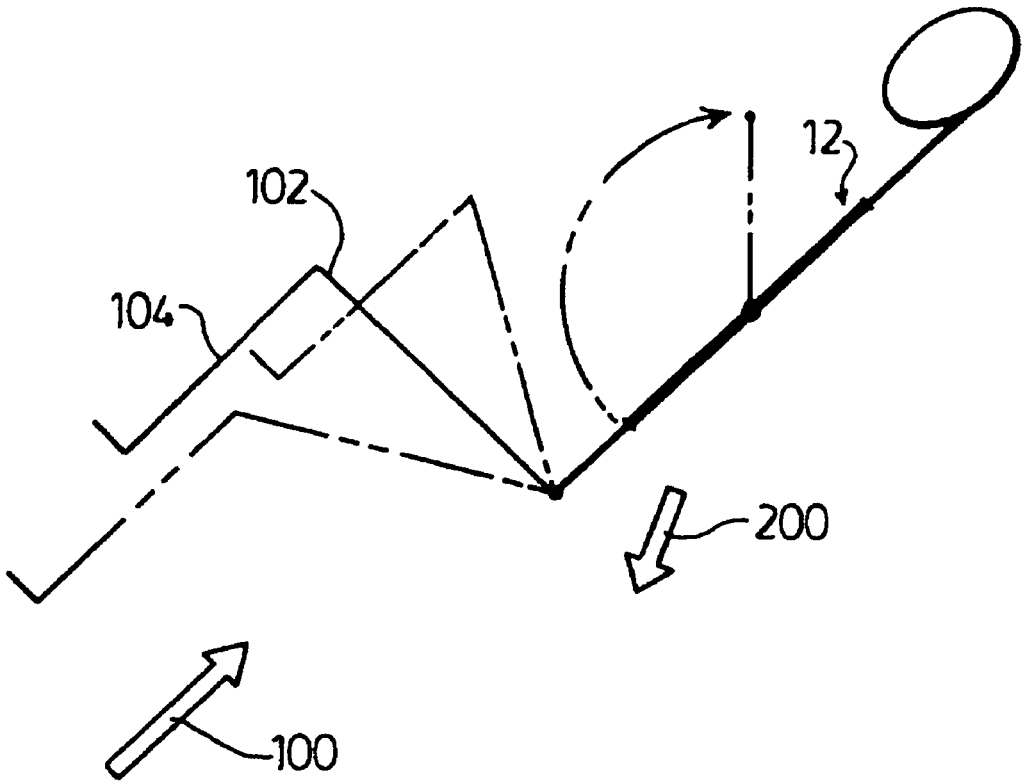
FIG. 7 shows schematically the positioning of a user on the exercise apparatus of FIG. 6 in operation.

Although not essential, most preferably, each hand pulley 150 is associated with a vertically positionable guide pulley 170 which is selectively positionable in a vertical direction relative to the seat back 80 to enable the user 12 to vary the angle of the force vector provided by the upper body exercising assembly 18. As for example as shown in FIG. 7, by lowering the pulleys 170 towards the bottom of the seat back 80, the upper body exercising assembly 18 is operable with the user pulling the hand pulleys 150 more angularly upward.

In this configuration, the guides 170 act in concert with the rods 160 to provide a resistance force vector 200 which is more generally opposite to the force vector 100 provided by the actuation of the foot support 40. The machine 110 may thus be used with higher resistive leg weight forces, with the upper body exercising assembly providing a counter force to assist in maintaining in the user in an exercising position on the seat 32. In use of the exercise machine 110, the user 12 pre-selects the desired amount of resistance to be applied to the foot frame 144 and hand pulleys 150. Resistance is selected by coupling a selected number of bendable rods 160 to each cable/pulley assembly 22,24. The user 12 then assumes the exercising position partially reclined against the seat back 80 as shown in FIG. 6.

With the user's feet resting against the foot frame 144, the user 12 grips hand pulleys 150. Exercising movement is effective by simultaneously performing leg presses against the foot frame 144 while pulling each of the hand pulleys 150 forward in the direction of arrow 400. The foot frame 144 and pulleys 150 are moved to the displaced biased positions shown in FIG. 7, with the user's leg fully extended forwardly in a generally straightened orientation, and his or her arms 104 pulled forwardly of the user's abdomen. Thereafter, the user 12 permits the foot frame 140 and hand pulleys 150 to return in the reverse direction to the rest position by the return bias of the bendable rods 160, and the cycle is thereafter repeated.

By the use of the machine 110, the foot frame 144 is thus operable to exercise quadricep muscles of the user's right and left legs in substantially unified movement and leg muscle exercise may be achieved concurrently while the user 12 activates the hand pulleys 150 against the resistance of the rods 160 to exercise the upper and lower body muscles, as well as achieving exercising movement of the abdominal muscles 106 as well. Simultaneously, with the user's feet engaging the foot plate, the user extends his or her legs in unified movement to move the foot frame 144 from the initial rest position to the second displaced position against the resistance provided by the rods 160.

Figure 8:
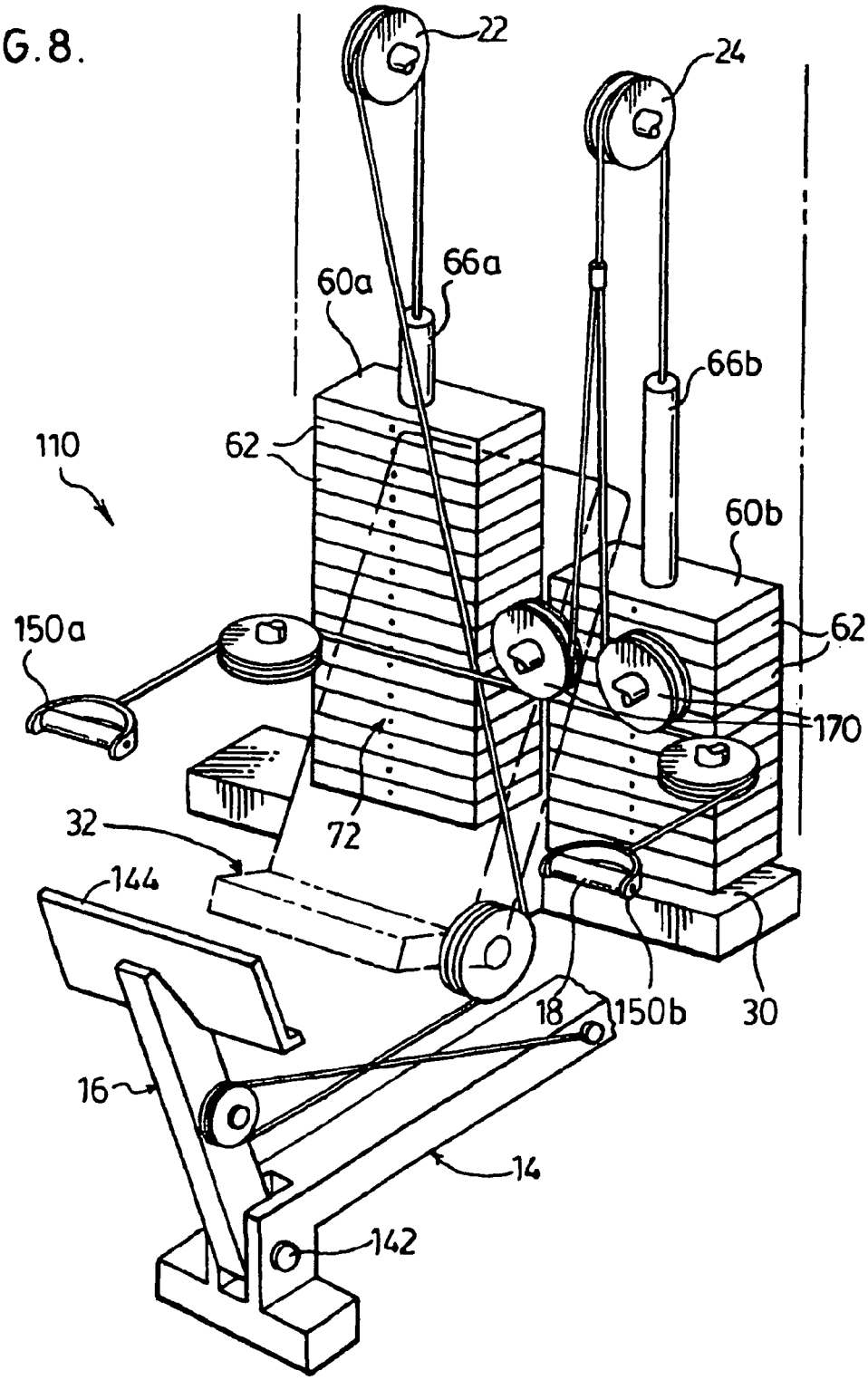
FIG. 8 shows a perspective view of an exercise apparatus in accordance with a further embodiment of the invention.

FIG. 8 shows schematically a modified exercise machine 110 in which like reference numerals are used to identify like components. In FIG. 8, the exercise machine 110 incorporates a weight stack assembly 20 similar to that described with reference to the embodiment shown in FIG. 1 as a resistance mechanism in place of the array of bendable rods 160. With the embodiment shown, individual weight stacks 60*a*,60*b* are coupled respectively via the cable/pulley assemblies 22,24 to the foot frame 144 and hand pulleys 150 to provide the desired degree of resistance.

The weight stack assembly 20 of FIG. 8 similarly enables the user 12 to sit at the exercise machine 110 and alternately and/or sequentially perform arm and leg exercises. In an alternate possible mode of use, the user 12 may choose to repeatedly alternate leg and arm exercises for muscle endurance training, without having to interrupt the flow by having to reposition the pins 72.

The applicant has appreciated that the construction of the present exercise machine and its method of use provide various advantages over conventional strength training apparatus. With the present invention, the user 12 utilizes his or her whole body by engaging the upper body, lower body and midsection muscles during exercise. With such upper body and lower body muscle exercise, the user 12 also exercises and utilizes the user's back and abdominal muscles more often than traditional equipment.

Although the detailed description describes and illustrates various preferred embodiments, the invention is not so limited. Many modifications and variations will now occur to persons skilled in the art. For a definition of the invention, reference may be had to the appended claims.

I claim:

1. An exercise apparatus to effect simultaneous upper and lower body strengthening in a user, the apparatus comprising, a seat having a seat back support for supporting said user in an exercising position with said user's spine juxtaposed thereon, the back support being inclined from vertical at a downwardly sloping angle selected at between about 10° and 60°, a lower frame assembly including a foot support actuable in movement by the extension and retraction of said user's legs, the foot support being movable along a first path of movement from a first raised position to a second lowered position, a first resistance mechanism coupled to the lower frame assembly and operable to selectively vary resistance to foot support movement, an arm exercising assembly actuable to exercise arm muscles of said user when in the exercising position, the arm exercising assembly including at least one reciprocally movable member which is selectively movable by said user's hands or arms along a second path of movement from an initial rest position to a displaced position moved therefrom, the second path of movement extending generally in a direction oriented at between about 80° and 280° relative to the downward inclination of said seat back, a second resistance mechanism coupled to said arm exercising assembly and operable to vary resistance to movement of said arm exercising assembly independently from said first resistance mechanism, wherein with said user in said exercising position, simultaneously actuating said lower frame assembly and said arm exercise assembly to effect simultaneous upper and lower body exercise, whereby, the exercising position comprises positioning the seat with said back support inclined from vertical such that the user can reach the lower frame assembly with said user's feet engaging said foot support while said user's hands engage said arm exercising assembly, in actuation of said lower frame assembly, said user engages said foot support with his or her feet to alternately extend and retract said user's legs together in unison in leg press-type exercises to move said foot support between the first raised and second lowered positions, and whereby in movement of the foot support from the first raised position to the second lowered position, the lower frame assembly maintains an orientation of the user's shins in a position generally parallel ±45° to the angle of inclination of the seat back, and as said user's legs are extended, the user simultaneously urges said reciprocally movable member with said user's arms from said initial rest position towards said displaced position.

2. The apparatus as claimed in claim 1 wherein said back support is positioned inclined at an angle selected at between about 30° and 60°.

3. The apparatus as claimed in claim 2 wherein as said foot assembly is moved to the lowered position, said lower frame assembly maintains said user's shins in said orientation in generally parallel ±25° to the angle of inclination of said back support.

4. The apparatus as claimed in claim 3, wherein each said reciprocally movable member moves from the initial said rest position to said displaced position in a direction selected at between about 90° and 270° relative to the downward direction of inclination of the seat back.

5. The apparatus as claimed in claim 4 further including positioning said first resistance mechanism to provide a pre-selected maximum leg resistance force selected at less than about 300 lbs, and positioning said second resistance mechanism to provide a pre-selected maximum arm resistance force of less than about 200 lbs.

6. The apparatus as claimed in claim 1 wherein said arm exercising assembly is selected from the group consisting of an outward shoulder press exercise apparatus and a chest press exercise apparatus, and wherein said user moves each said reciprocally member, along said second path of movement, each said reciprocally movable member moves in a direction generally perpendicular ±10° relative to a direction of inclination of the seat back.

7. The apparatus as claimed in claim 6 wherein the exercise apparatus is a free standing unitary exercise apparatus and prior to actuation of the lower frame assembly, said user adjusts the first resistance mechanism to pre-select a desired resistance to foot support movement, and said user adjusts the second resistance mechanism to pre-select a desired resistance to said at least one reciprocally moveable member.

8. The apparatus as claimed in claim 7 wherein in actuation of said lower frame assembly, in said first rest position said foot support being spaced towards said seat and engaged by the soles of both of said user's feet with said user's legs in a partially bent orientation, and in said second position said foot support being moved vertically downwardly to a distal location and engaged by the soles of said user's feet with said user's legs in a substantially fully extended orientation and said user's shins oriented generally parallel ±20° to the angle of inclination of the seat back.

9. An exercise apparatus to effect muscle strengthening and toning in a user, the apparatus comprising, a seat having a seat back support for supporting said user's spine in an exercising position thereagainst, the back support being fixedly positioned inclined in a downwardly sloping direction from vertical at an angle selected at between about 10° and 60°, a lower frame assembly actuable by said user to effect leg muscle exercises, the lower frame assembly including a foot support which is reciprocally movable relative to the seat between a first position, wherein said foot support is engagable by said user's feet with said user's legs bent and the user's shins in general alignment ±45° with the angle of inclination back support, and a second position moved away from the seat, wherein said foot support is engagable by said user's feet with said legs in a generally outstretched position while maintaining the user's shins in general alignment ±35° with the angle of inclination of the back support, a first resistance mechanism coupled to the lower frame assembly and operable to provide a user selected resistance to foot support movement, an arm exercising assembly actuable to exercise arm muscles of said user when in the exercising position, the arm exercising assembly including a reciprocally movable member which is selectively movable by said user's hands and/or arms from an initial rest position and a displaced position moved therefrom in a direction oriented at between about 80° to about 280° relative to the downward sloping direction of the back support, a second resistance mechanism coupled to said arm exercising assembly and operable to provide a user selected resistance to movement of said reciprocally movable member independent from said first resistance mechanism, wherein in use of the apparatus, the exercising position comprising providing the seat with the seat back support inclined from vertical in a position whereby the foot support is engagable by said user's feet while said user's hands or arms engaging said arm exercising assembly, said user simultaneously activates said lower frame assembly and said arm exercise assembly whereby, in actuation of said lower frame assembly, said user engages said foot support with both of his or her feet to alternately extend and retract said user's legs together in unison in leg exercises to move said foot support between the first position and the second position, and with or immediately following each extension and retraction of said user's legs, said user moves said hands and/or arms to reciprocally move said reciprocally movable member against the resistance of the second resistance mechanism from said initial rest position to said displaced position.

10. The exercise apparatus as claimed in claim 9 wherein said user moves said reciprocal movable member from the rest to said displaced position substantially simultaneously with the extension of said user's legs, said first resistance mechanism providing a range of resistance forces selected less than a maximum of about 250 lbs, and said second resistance mechanism providing a range of resistance forces selected less than a maximum of about 150 lbs.

11. The apparatus as claimed in claim 10 wherein said arm exercising assembly is selected from the group consisting of an outward shoulder press exercise apparatus and a chest press exercise apparatus, and wherein said reciprocally movable member comprises a rigid frame which is movable in a direction generally perpendicular ±10° the angle of inclination of the back support.

12. The apparatus as claimed in claim 9 wherein as said user extends his or her legs to move the foot support from the first position to the second position, said user substantially simultaneously moves the reciprocal member against resistance of the second resistance mechanism from the initial rest position to the displaced position.

13. The apparatus as claimed in claim 12 wherein the user actuates the lower frame assembly to effect the exercise of quadricep muscles of said user's right and left legs in substantially unified movement, in said first position said foot support being spaced towards and positioned vertically beneath said seat and engaged by the soles of said user's feet, and in said second position said foot support being pivoted to a distal location spaced downwardly therefrom and engaged by the soles of said user's feet with said user's legs in a substantially fully extended orientation and said user's shins oriented generally parallel ±25° to the angle of inclination of the seat back.

14. The exercise apparatus as claimed in claim 9 wherein said exercise apparatus comprises a free standing unitary apparatus, said foot support is moved along a generally downwardly curving arc as said lower frame assembly moves from said first position towards said second position.

15. An exercise apparatus to effect simultaneous arm, leg and core muscle group exercises in a user, the apparatus comprising, a seat having a seat back support for supporting said user's spine in an exercising position, the back support being oriented in a downward inclined first direction relative to vertical at an angle selected at between about 25° and 50°, a lower frame assembly actuable by said user to effect leg muscle exercises, the lower frame assembly including a foot pedal which is engagable by the soles of said user's feet in reciprocal movement relative to the seat between a first rest position to a second position moved downwardly therefrom, a first resistance mechanism coupled to the lower frame assembly to provide a selected resistance to foot support movement towards the second position, an arm exercising assembly actuable to exercise arm muscles of said user when in the exercising position, the arm exercising assembly including a reciprocally movable member which is selectively movable by said user's hands and/or arms between an initial rest position and a displaced position moved therefrom in a second direction oriented at between 80° and 280° relative to the first direction, and a second resistance mechanism coupled to said arm exercising assembly to provide a selected resistance to the movement of reciprocally movable member towards the displaced position independent of said first resistance mechanism, whereby positioning the apparatus to support the user in the exercising position with said user's spine is in juxtaposed contact with said seat back inclined relative to vertical whereby said user's feet concurrently engage said foot pedal while said user's hands and/or arms engaging said arm exercising assembly, actuating said lower frame assembly, whereby said user engages said foot pedal with the soles of both of his or her feet, and symmetrically extends and retracts said legs in unison in leg exercises to move said foot support between the first and second positions, with the first resistance mechanism and foot support providing a resistance leg force to said user's legs in a direction ±35° the direction of inclination of the seat back, and said user substantially simultaneously moves said reciprocally movable member from said initial rest position to said displaced position, with the second resistance mechanism and reciprocally movable member providing a resistance arm force to said user's hands and/or arms in a direction generally opposite to the second direction.

16. The apparatus as claimed in claim 15 wherein a first pulley system mechanically couples the first resistance mechanism to the lower frame assembly, and a second pulley system mechanically couples the second resistance mechanism to the arm exercising assembly, wherein prior to actuating each of said lower frame assembly and said arm exercising assembly, said user selectively varies the first and second resistance mechanisms to pre-select desired leg and arm resistance forces, and further wherein in the first rest position, the foot pedal being spaced a vertical distance below the seat, and in the second position the lower frame assembly orienting said user's shins in general alignment ±35° with the downward inclination of the seat back.

17. The apparatus as claimed in claim 15 further comprising fixedly securing said seat back inclined at an angle of between about 30° and 45°, from vertical, wherein in said first rest position, said user's feet engage said foot support with said user's legs bent and the user's shins in general alignment ±25° with the angle of inclination back support; and in said second position said user's feet engage said foot support with said legs in a generally outstretched position while maintaining the user's shins in general alignment ±25° with the angle of inclination of the back support.

18. The apparatus as claimed in claim 15 wherein the user extends and retracts said user's legs to exercise quadricep muscles of said user's right and left legs in substantially unified movement, and wherein, in said first rest position said foot support being spaced towards said seat at a proximal location selected to be engagable by said user's feet with said user's legs in a partially bent orientation, and in said second position said foot support being pivoted to a distal location spaced downwardly therefrom and engaged by said user's feet with said user's legs in a substantially fully extended orientation.

19. The apparatus as claimed in claim 16 wherein as said user's legs are extended, first resistance mechanism and said lower frame assembly provide a resistance leg force in an opposing direction generally parallel ±25° to the direction of inclination angle of the seat back.

20. The apparatus as claimed in claim 15 wherein each said second direction is oriented at between about 90° and 270° relative to the first direction.

* * * * *